US009254046B1

(12) United States Patent
Arenstein

(10) Patent No.: US 9,254,046 B1
(45) Date of Patent: Feb. 9, 2016

(54) DEVICE AND METHOD FOR SECURING A BED SHEET

(71) Applicant: Jon Arenstein, Wellington, FL (US)

(72) Inventor: Jon Arenstein, Wellington, FL (US)

( * ) Notice: Subject to any disclaimer, the term of this patent is extended or adjusted under 35 U.S.C. 154(b) by 0 days.

(21) Appl. No.: 14/826,293

(22) Filed: Aug. 14, 2015

(51) Int. Cl.
*A47C 21/02* (2006.01)
*A47C 21/00* (2006.01)

(52) U.S. Cl.
CPC ..... *A47C 21/022* (2013.01)

(58) Field of Classification Search
CPC ..... A47G 9/02; A47G 9/04; A47G 9/00; A47G 2009/004; A47C 21/00; A47C 21/02; A47C 21/022; A47C 21/028; A47C 31/00; A47C 31/003; Y10T 24/23; Y10T 24/32; A44D 2203/00; A41F 1/002
USPC ..... 5/504.1, 503.1, 658, 659, 496, 498, 5/488, 482, 692, 693, 690, 906; 24/72.5, 24/303
See application file for complete search history.

(56) References Cited

U.S. PATENT DOCUMENTS 7,337,481 B2 * 3/2008 Gilbert ..... A47D 15/008 24/303
8,464,377 B1 * 6/2013 Carson ..... A47G 9/02 24/303
8,522,378 B2 * 9/2013 Argento ..... A47G 9/02 5/482
8,898,834 B1 * 12/2014 Huber ..... A47C 31/105 5/482
8,973,184 B2 * 3/2015 Edgren ..... A47G 9/0292 160/123
2008/0028524 A1 * 2/2008 Gilbert ..... A47D 15/008 5/498
2010/0275374 A1 * 11/2010 Hipp ..... A47G 9/0246 5/496
2012/0233777 A1 * 9/2012 Hare ..... A47C 21/022 5/498
2012/0246828 A1 * 10/2012 Argento ..... A47G 9/02 5/486
2013/0180050 A1 * 7/2013 Koci ..... A47G 9/02 5/496
2014/0033429 A1 * 2/2014 Edgren ..... A47G 9/0292 5/493

* cited by examiner

*Primary Examiner* — Robert G Santos
(74) *Attorney, Agent, or Firm* — The Law Office of Jerry D. Haynes

(57) ABSTRACT

A device for securing bed sheets that includes: a top plate, where the top plate includes an opening at each end of the top plate; a bottom plate, where the bottom plate includes an opening at each end of the top plate; at least two straps, where the straps extend through the openings in the top plate and bottom plate and provide a means to secure the top plate and bottom plate to a corner of a mattress; a plurality of magnets within the top plate; and a securing plate. Preferably, a buckle may be provided for each strap, where the buckle provides a means to tighten each respective strap. In one particular embodiment, the plurality of magnets includes three evenly spaced magnets. Further, the top plate may include three snap components with openings to allow the insert of the plurality of magnets. Preferably, the plurality of magnets includes rare earth neodymium magnets.

8 Claims, 3 Drawing Sheets

DEVICE AND METHOD FOR SECURING A BED SHEET

BACKGROUND OF THE INVENTION

1. Field of Invention

The present invention relates to a plate and strap system that is used to secure a corner of a bed sheet onto a mattress.

2. Description of Related Art

As is well known, a fitted sheet is typically used to cover a mattress during use. The fitted sheet normally comes with elastic corners and fits over each corner of the mattress during use. Although effective, a fitted sheet can be cumbersome and difficult to use, clean and store. The fitted sheet on certain occasions actually slips off the bed after a period time of use. Further use of fitted sheet may be difficult for certain individuals with certain physical limitations such as arthritis, back issues or any injury that results that may prevent them from applying enough force to place the sheet over the mattress. Another drawback to fitted sheets is the difficulty in folding the sheet properly after washing the sheet. Therefore it would be advantageous to have a device that could be easily placed over the corner of a mattress to secure a flat sheet into position therefore eliminating the need for a fitted sheet over a mattress.

SUMMARY OF THE INVENTION

The present invention relates to a device for securing bed sheets that includes: a top plate, where the top plate includes an opening at each end of the top plate; a bottom plate, where the bottom plate includes an opening at each end of the top plate; at least two straps, where the straps extend through the openings in the top plate and bottom plate and provide a means to secure the top plate and bottom plate to a corner of a mattress; a plurality of magnets within the top plate; and a securing plate. Preferably, a buckle may be provided for each strap, where the buckle provides a means to tighten each respective strap. In one particular embodiment, the plurality of magnets include three evenly spaced magnets. Further, the top plate may include three snap components with openings to allow the insert of the plurality of magnets. Preferably, the plurality of magnets includes rare earth neodymium magnets.

DETAILED DESCRIPTION

Figure 1:
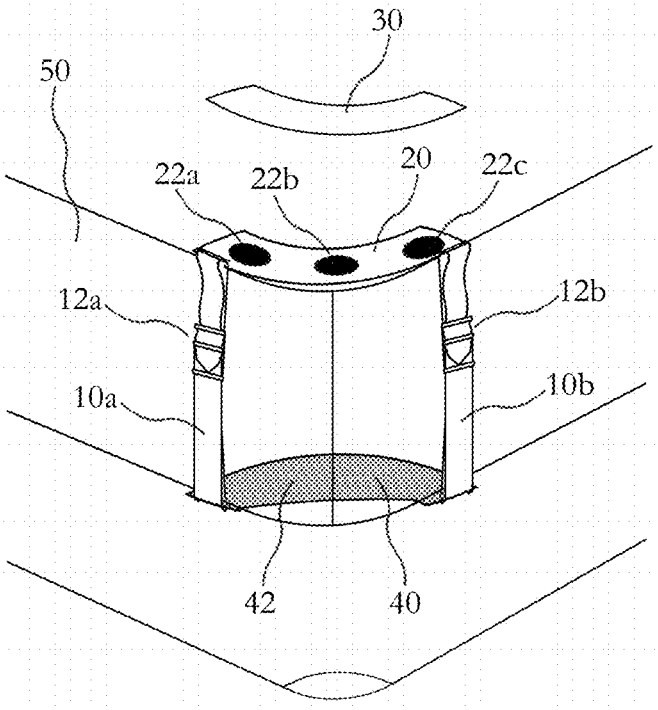
FIG. 1 depicts a device for securing a flat sheet at the corner of a mattress in accordance with the present invention.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

The present invention relates to a device that uses a top and bottom plate secured with straps at a corner of a mattress to secure a flat sheet or fitted sheet onto the mattress. The top plate includes a magnetic connection that incorporates magnets in the top plate and an adjoining securing plate that connects over the top plate that places the sheet in a stationary position. Straps are on each end of the plate extend through openings and secure the bottom plate under the mattress and the top plate over the top of mattress. This device may be used at each corner of the mattress to secure a flat sheet or fitted sheet in a stationary position. Preferably the plates are in a boomerang shape curved to align with the corner of the mattress.

Figure 2A:
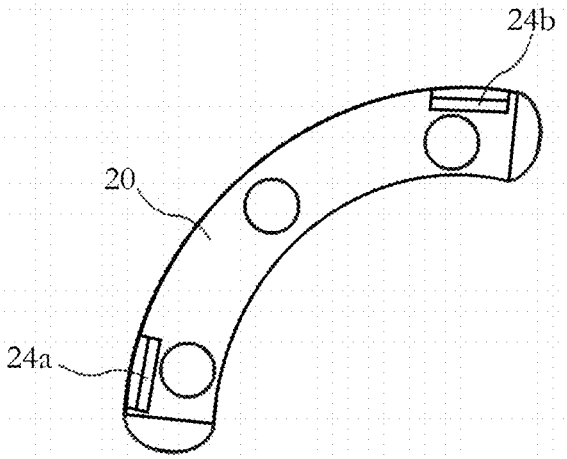
FIG. 2A depicts a top plate used with the device in accordance with the present invention.
Figure 2B:
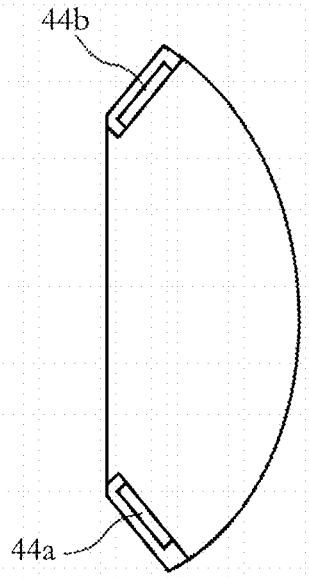
FIG. 2B depicts a bottom plate used with the device in accordance with the present invention.

In reference to FIG. 1, the device for securing a flat sheet is depicted in accordance with the present invention. A partial view of a Mattress 50 is shown that is focused on a single corner of the mattress. The device is attached to the corner of the Mattress 50 in accordance with the present invention. The device includes a top Plate 20 and a bottom Plate 40. The top Plate 20 is placed over the top of the mattress and secured to the mattress with straps 10*a*, 10*b*. Buckles are 12*a*, 12*b* provided on each respective strap. The straps 10*a*, 10*b* extend from the top Plate 20 to the bottom Plate 40 during use. Openings 24*a*, 24*b* are provided in the top Plate 20 as shown in FIG. 2. These openings 24*a*, 24*b* provide a means for insertion of the straps through the top Plate 20. Similar openings 44*a*, 44*b* are provided on the bottom Plate 40. Once the straps 10*a*, 10*b* are connected, the plates 20, 40 are positioned over a corner of the Mattress 50. The buckles 12*a*, 12*b* are tightened and secures the plates into a position. One unique feature of this particular invention are magnets 22*a*, 22*b*, 22*c* that are provided within the top Plate 20. The magnets 22*a*, 22*b*, 22*c* adjoin to a securing Plate 30 as shown in FIG. 1. The sheet therefore are positioned over the top Plate 20 and the securing Plate 30 plate is placed on top of the sheet to secure the sheet into position over the mattress.

Figure 3:
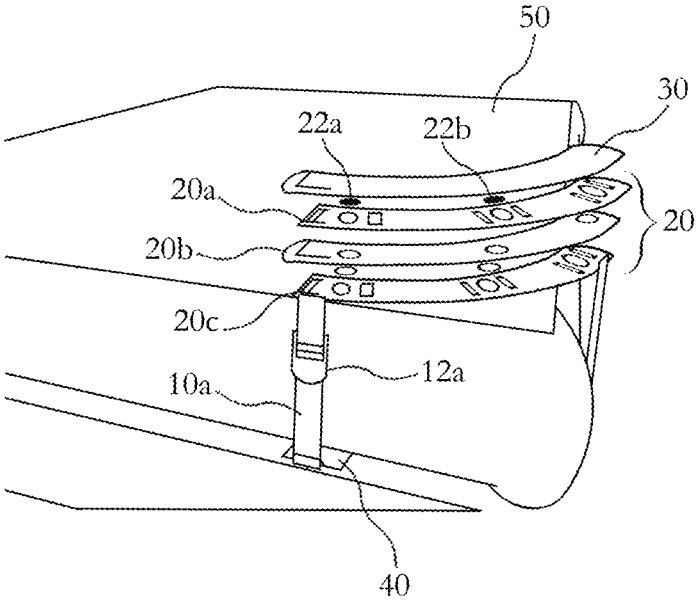
FIG. 3 depicts an exploded view of the top plate used in accordance with the present invention.

FIG. 3 depicts an expanded view of the top Plate 20. The top Plate 20 is comprised of three snap components, an upper snap component 20*a*, a mid snap component 20*b* and a lower snap component 20*c*. Openings are provided in these snap components to allow for the assertion of the magnets 22*a*, 22*b*, 22*c*. The magnets 22*a*, 22*b*, 22*c* preferably are rare earth neodymium magnets. The top plate may be made of molded plastic. Preferably, the magnets may vary in size and number, however a minimum pull force of 6 lbs. or greater is necessary to ensure that the attraction force is adequate to hold a sheet in place.

During use, a user places the bottom plate 40 under the corner of the mattress 50 between the box spring and mattress 50. Once in place the top Plate 20 is placed on the top corner of the mattress. The user positions the top and bottom plates 20, 40 into position, tightens each strap 10*a*, 10*b*, slides the sheet over the plates 20, 40 and straps 10*a*, 10*b*, and then places the securing Plate 30 into position. This process is repeated for each corner of the Mattress 50. The securing plate 30 joins to the top plate 20 through the magnetism provided by magnets 22*a*, 22*b*, 22*c*. The magnets 22*a*, 22*b*, 22*c* help to insure that the device stays secure to the mattress and a user may only have to remove the securing plate 30 to change the sheets on the mattress. The straps 10*a*, 10*b* may be made of nylon and include elastics to provide a firm but flexible placement of the plate onto each corner of the mattress. In addition to a flat sheet a person may secure a traditional fitted sheet providing further security of a fitted sheet onto the mattress. Further metal is included in the material of the securing plate 30 in order have the necessary attraction to the magnets 22*a*, 22*b*, 22*c* of the top plate 20.

In another embodiment of the present invention, the bottom Plate 40 may be removed and replaced with essentially a strap or one continuous strap to hold the top Plate 20 into place over the corner of the Mattress 50. Further the top Plate 20 may also be integrated into the top surface of the mattress therefore eliminating the need for straps in using the present invention. Although the bottom Plate 40 may be modified the top Plate 20 remains in place as described above. In particular, the magnets aligned within the top Plate 20 are joined with the securing Plate 30 placing and securing the sheet into place over each corner of the Mattress 50. In another variation of this embodiment, a single nylon strap includes magnets sewn in the top of the strap creating a stretchy band to hold the strap in place. So the single nylon strap may include magnets sewn in the top portion of the strap to hold the securing plate into place over the mattress. Further in a third embodiment, adjustable strings may be used in place of the nylon strap to hold the top plate in place over the top of the mattress. The top plate may includes one or more magnets that are either in the form of plastic or fabric to include the magnets which may be either flat, round, square or any shape to provide a significant magnetic force to hold the securing plate into place.

The instant invention has been shown and described in what it considers to be the most practical and preferred embodiments. It is recognized, however, that departures may be made there from within the scope of the invention and that obvious modifications will occur to a person skilled in the art.

What is claimed is:

1. A device for securing bed sheets comprising:

a. a top plate, where the top plate includes openings at opposite ends of the top plate;

b. a bottom plate, where the bottom plate includes openings at opposite ends of the bottom plate;

c. at least two straps, where the straps extend through the openings in the top plate and bottom plate and provide a means to secure the top plate and bottom plate to a corner of a mattress;

d. a plurality of magnets within the top plate; and e. a securing plate including a metal material providing a means to join to the top plate through the magnetism provided by the magnets.

2. The device for securing bed sheets according to claim 1, where a buckle is provided for each strap, where the buckles provide a means to tighten the straps.

3. The device for securing bed sheets according to claim 1, where said plurality of magnets include three evenly spaced magnets.

4. The device for securing bed sheets according to claim 1, where the top plate includes three snap components with openings to allow the insert of the plurality of magnets.

5. The device for securing bed sheets according to claim 1, where the plurality of magnets includes rare earth neodymium magnets.

6. The device for securing bed sheets according to claim 1, where the top plate is made of molded plastic.

7. The device for securing bed sheets according to claim 1, where the at least two straps are made of nylon.

8. A method of securing a sheet to a mattress comprising the steps of:

a. placing a bottom plate under a first corner of a mattress;

b. placing a top plate on top of the mattress at the first corner, where the top plate includes a plurality of magnets;

c. securing the top plate to the bottom plate by using straps extending between the top plate and the bottom plate;

d. tightening the straps to secure the top plate and bottom plate into place at the first corner;

e. repeating steps a-d for each remaining corner of the mattress;

f. placing a sheet over the mattress; and g. securing the sheet into place by joining a securing plate placed on top of the sheet and including a metal material to each top plate, where each securing plate and top plate are joined through the magnetism provided by the plurality of magnets.

* * * * *